US010239102B2

(12) United States Patent
Schäfer et al.

(10) Patent No.: US 10,239,102 B2
(45) Date of Patent: Mar. 26, 2019

(54) ROLLING ROD AS AN INNER TOOL IN THE PRODUCTION OF SEAMLESS METAL HOLLOW BODIES AND METHOD FOR PRODUCING A METAL HOLLOW BODY

(71) Applicant: Vallourec Deutschland GmbH, Düsseldorf (DE)

(72) Inventors: Nils Schäfer, Düsseldorf (DE); Rolf Kümmerling, Duisburg (DE); Stéphanie Demars, Marly (FR); Hélène Dalmont, Valenciennes (FR)

(73) Assignee: Vallourec Deutschland GmbH, Düsseldorf (DE)

( * ) Notice: Subject to any disclaimer, the term of this patent is extended or adjusted under 35 U.S.C. 154(b) by 270 days.

(21) Appl. No.: 15/109,187

(22) PCT Filed: Jan. 5, 2015

(86) PCT No.: PCT/EP2015/050065
§ 371 (c)(1),
(2) Date: Jun. 30, 2016

(87) PCT Pub. No.: WO2015/104244
PCT Pub. Date: Jul. 16, 2015

(65) Prior Publication Data

US 2016/0325325 A1 Nov. 10, 2016

(30) Foreign Application Priority Data

Jan. 7, 2014 (DE) ..... 10 2014 100 107

(51) Int. Cl.
*B21B 25/00* (2006.01)
*B21B 17/02* (2006.01)
*C23C 8/26* (2006.01)

(52) U.S. Cl.
CPC ..... *B21B 25/00* (2013.01); *B21B 17/02* (2013.01); *C23C 8/26* (2013.01)

(58) Field of Classification Search
CPC ..... B21B 25/00; B21B 25/04; B21B 17/02
See application file for complete search history.

(56) References Cited

FOREIGN PATENT DOCUMENTS

CN 1093622 A 10/1994
CN 1795061 A 6/2006
(Continued)

OTHER PUBLICATIONS

Preliminary Report on Patentability of the International Searching Authority in English from corresponding Patent Cooperation Treaty (PCT) Application No. PCT/EP2015/050065, original report in German completed Dec. 11, 2015.
(Continued)

*Primary Examiner* — Teresa M Ekiert
(74) *Attorney, Agent, or Firm* — Gardner, Linn, Burkhart & Ondersma LLP

(57) ABSTRACT

A rolling rod configured as an inner tool in the production of seamless hollow bodies, such as seamless pipes. The rolling rod has a nitrided surface layer and may consist of a heat-resistant steel material having a chromium equivalent calculated by a formula, as well as has a minimum hardness, yield point and tensile strength. A seamlessly hot-rolled, metallic hollow body is produced by a stretch-forming procedure in a multiple-stand rolling mill via the rolling rod which is threaded into the hollow block. Prior to threading the rolling rod into the hollow block, the rolling rod is provided with a liquid lubricant and is subsequently dried. The rolling rod is threaded in with a clearance with respect to the inner diameter of the hollow block. Prior to threading-
(Continued)

in the rod, the hollow block may have an average temperature of at least 1000° C., with the rod having a determined speed.

22 Claims, 2 Drawing Sheets

(56) References Cited

FOREIGN PATENT DOCUMENTS

| | | | |
|---|---|---|---|
| CN | 101400455 | A | 4/2009 |
| DE | 3742155 | A1 | 6/1989 |
| DE | 19714317 | C1 | 6/1998 |
| EP | 0601932 | A1 | 6/1994 |
| EP | 1637245 | A1 | 3/2006 |
| EP | 1775038 | A1 | 4/2007 |
| JP | H05253613 | A | 10/1993 |
| JP | H06262220 | A | 9/1994 |
| JP | H0871618 | A | 3/1996 |
| JP | 2003253422 | A | 9/2003 |
| JP | 2009045632 | A | 3/2009 |
| WO | 2004108311 | A1 | 12/2004 |

OTHER PUBLICATIONS

International Search Report of the International Searching Authority from corresponding Patent Cooperation Treaty (PCT) Application No. PCT/EP2015/050065, dated Mar. 4, 2015.

Written Opinion of the International Searching Authority from corresponding Patent Coopeartion Treaty (PCT) Application No. PCT/EP2015/050065, indicated completed on Jul. 16, 2015.

International Preliminary Examination Report from corresponding Patent Cooperation Treaty (PCT) Application No. PCT/EP2015/050065, transmitted Dec. 11, 2015.

ROLLING ROD AS AN INNER TOOL IN THE PRODUCTION OF SEAMLESS METAL HOLLOW BODIES AND METHOD FOR PRODUCING A METAL HOLLOW BODY

CROSS REFERENCE TO RELATED APPLICATION

The present application claims the priority benefits of International Patent Application No. PCT/EP2015/050065, filed on Jan. 5, 2015, and claims benefit of DE 10 2014 100 107.9, which are hereby incorporated herein by reference in their entireties.

BACKGROUND OF THE INVENTION

The invention relates to a rolling rod as an inner tool in the production of seamless metallic hollow bodies, in particular stretch-forming of metallic hollow blocks to form seamless pipes by means of a multiple-stand rolling mill, having a surface comprising a nitriding layer. The invention also relates to a method for producing a seamlessly hot-rolled, metallic hollow body, in particular a steel pipe, in which a previously produced hollow block is subjected to a stretch-forming procedure in a multiple-stand rolling mill by means of a rolling rod in accordance with the present invention which is threaded therein, and prior to the commencement of rolling, i.e. the beginning of threading the rolling rod into the hollow block, the rolling rod is provided with a liquid lubricant and which is subsequently dried.

After the invention by the Mannesmann brothers of producing a thick-walled hollow block pipe from a heated block by means of rolling, there have been various proposals for stretch-forming this hollow block pipe in the same heat in a further heat working step, upon which in a third rolling step the outer diameter is reduced to the finished diameter of the rolling mill. Keywords in this regard include the back-step method, push bench method, plug rolling method and rod rolling method. In the first rolling step, a rotary forge mill produces a so-called hollow block from a block which is generally solid. In exceptional cases, pre-bored blocks can also be used instead of solid blocks. In the second rolling step, the hollow block is stretch-formed, wherein nowadays multiple-stand rod rolling mills are predominantly used for this purpose. The stretch-forming of the hollow block, which enters the rolling mill and is at a temperature of about 1000 to 1200° C. is effected by means of a rolling rod. For this purpose, the rolling rod is threaded into the hollow block and for the most part is conveyed by a driven transport roller to the first rolling stand. The number of rollers per stand is typically at least two, but nowadays it is often three, wherein the process sequence is as follows.

Rod rolling mills are distinguished on the one hand according to the manner in which the rod speed is controlled, and on the other hand according to the number or rollers per stand, wherein two or three rollers can be provided. A plurality of stands are always connected one behind the other. In the case of the method variant considered in this case, the rolling rod moves during the actual rolling procedure at a constant speed through the rolling mill. For this purpose, the rolling rod must be retained by an electromechanical system and also guided in a controlled manner to achieve the constant rolling rod speed. The retention system is referred to as a retainer. In order to ensure that, after the rolling rod has been threaded into hollow block during longitudinal stretch-forming, the hollow block to be rolled can slide on the rolling rod during rolling, the rolling rod must be provided beforehand with a lubricant. For this purpose, a graphite-containing lubricant is typically sprayed in liquid form onto the rolling rod and is dried at temperatures of 80 to 130° C. At lower temperatures the lubricant does not completely dry out in a reliable manner and at higher temperatures the so-called Leidenfrost effect occurs, as a result of which a uniform layer is not created and parts of the surface remain unlubricated. Therefore, the attempt is to perform the drying at temperatures below 100° C.

In addition to lubricating the rolling rod, in accordance with European patent specification EP 1 775 038 B1 the hollow blocks to be rolled are sprayed internally with a deoxidant (e.g. borax) prior to the stretch-forming procedure in the rod rolling mill, in order to dissolve the oxide scale which results after rolling of the hollow block, wherein the dissolved oxide scale acts like additional lubrication. A disadvantage in this case is the use of borax which can be have a gene-altering effect and therefore should not be used.

The hollow block located on the rolling rod is then rolled out in the rod rolling mill to form a so-called mother pipe. The term "mother pipe" is used because in the third rolling step pipes having various finished diameters can be produced from the same mother pipe dimension by means of size rolling or stretch reducing. The rolling rod itself generally consists of a working part and a blank part. The blank part is required in order to bridge distances which are necessary in terms of process technology. Therefore, rolling does not take place on the blank part of the rolling rod. For the sake of simplicity, the term "rod length" will be used hereinafter to refer to the length of the working part.

Although highly heat-resistant steels based on chromium-molybdenum are typically used as the rod material, in particular the materials which are difficult to form cannot be rolled without encountering problems. Such materials frequently contain chromium, such as e.g. 100 Cr6 or the corrosion-resistant steels for the energy sector having chromium contents of greater than 5 wt %. The rolling rod is subjected to dispropor-tionate thermal loading and abrasion by these materials and the service life of the rolling rod is considerably reduced. This problem increases as the chromium content of the steels increases. Moreover, the risk of defects on the inner surface of the pipes caused by prematurely worn rolling rods is considerably increased.

In order to minimise the coefficient of friction, it is known from German laid-open document DE 37 42 155 A1 to chromium-plate the rolling rod surface and to apply a lubricant. However, chromium-plating releases toxic chromium IV which is harmful to the environment, for which reason alternative solutions have been sought.

In order to increase the service life of these rolling rods, which are subjected to extensive thermal loading and abrasion, during rolling in particular of chromium-containing steels and in order to minimise friction-induced defects on the inner surfaces of the pipes, it is known from Japanese laid-open document JP 06262220 A to chromium-plate the rolling rods instead with a nitriding layer which has a roughness of 0.5 to 5.0 μm. Details relating to required layer thicknesses are not provided.

In Japanese laid-open document JP 2009045632 A, the nitrided layer is supplemented by an oxide layer, to be applied thereon, in order to ensure that the service life of the rolling rod is impressive. The layer thickness of the nitriding layer is stated as being 50-500 micrometers, and that of the oxide layer is stated as being 3-20 micrometers.

Tests have shown that although nitrided surfaces have emergency operating characteristics when the lubricating film tears off during rolling, the service life of the rolling rods treated in this manner still cannot be significantly improved and defects on the inner surfaces of the pipes still cannot be significantly reduced.

The difficulty in using surface-nitrided rolling rods which are known per se resides in adapting the entire process, from producing the rolling rods, pre-treating the hollow block, lubricating the rod to the rolling process itself, to suit each other such that an assured rolling process is guaranteed for steel pipes consisting of unalloyed steel grades right through to chromium-containing steels which are difficult to hot-form.

Furthermore a rolling mandrel is already known form the German patent document DE 197 14 317 C1 which is provided with a surface layer via a PVD (physical vapour deposition) method on the basis of CrN.

SUMMARY OF THE INVENTION

The present invention provides a rolling rod as an inner tool in the production of seamless metallic hollow bodies, in particular stretch-forming of metallic hollow blocks to form seamless pipes by means of a multiple-stand rolling mill, and to provide a method for producing a seamlessly hot-rolled, metallic hollow body, in particular a steel pipe, whereby in the case of pipe materials which are difficult to form, in particular chromium-containing pipe materials, an improved service life of the rolling rod is achieved and defects on the inner surface of the pipe which arise during rolling are effectively minimised or avoided. Furthermore, in comparison with the known nitrided rolling rods, a comparable or improved service life is to be achieved without having to deoxidise the hollow block inner surface with borax-containing agents.

In accordance with the teaching of the invention, a rolling rod is used as an inner tool in the production of seamless metallic hollow bodies, in particular stretch-forming of metallic hollow blocks to form seamless pipes by means of a multiple-stand rolling mill, having a surface comprising a nitriding layer, wherein the rolling rod consists of a heat-resistant steel material

- having a chromium equivalent $Cr_{eq.}$ of more than 6.5, calculated according to $Cr_{eq.}$=% Cr+% Mo+1.5×% Si+0.5×% Nb+2×% Ti (1),
- having a minimum hardness of 200 HV 0.5, measured 0.5 mm below the surface of the rolling rod,
- having a yield point of at least 450 MPa at 500° C. and
- having a tensile strength of at least 600 MPa at 500° C., and
- starting from the surface, the nitriding layer has a depth of more than 0.15 mm and a nitriding hardness of more than 950 HV 0.5.

The invention also provides a method for producing a seamlessly hot-rolled, metallic hollow body, in particular a steel pipe, in which a previously produced hollow block is subjected to a stretch-forming procedure in a multiple-stand rolling mill by means of a previously described, inventive rolling rod which is threaded therein, and prior to the commencement of rolling, i.e. the beginning of threading the rolling rod into the hollow block, the rolling rod is provided with a liquid lubricant and which is subsequently dried, wherein the rolling rod is threaded in with a clearance in terms of a circumferential peripheral clearance with respect to the inner diameter of the hollow block of at least 10 mm, and immediately prior to the commencement of threading-in of the rod, the hollow block has an average temperature of at least 1000° C. and in terms of a maximum speed the rod speed $V_{ST}$ during rolling in a rod rolling mill satisfies the following conditions:

$$V_{STmax}=0.9\times\text{rod length/rolling time of last stand} \quad (3),$$

$$V_{STmax}=0.9\times V_{Mmin} \quad (4),$$

wherein $V_{Mmin}$ is the minimum speed of the pipe material during rolling in the rod rolling mill.

A rolling rod is understood to be a rod which, in contrast to a mandrel rod, does not have a head with an enlarged diameter but rather is a rod with a round cross-section of a constant size.

The proposed method and the rolling rod used for this purpose have the advantage that hollow bodies consisting of materials which are difficult to form can now also be economically produced having an optimum inner surface whilst at the same time the service life of the rolling rod is considerably increased.

Against expectation, tests have shown that the combination of the inventive features of rolling rod material, nitriding layer and length of the working part of the rolling rod delivers the desired result.

DETAILED DESCRIPTION OF THE PREFERRED EMBODIMENTS

Within the scope of the tests carried out, in a first step the hot working steels which are suitable for nitriding and demonstrate a basic hardness adequate for the rolling process are selected from the set of hot working steels. Table 1 shows that a chromium equivalent of greater than 6.5 is required for this purpose, wherein in this case the chromium equivalent is calculated in accordance with the following equation:

$$Cr_{eq.}=\%\ Cr+\%\ Mo+1.5\times\%\ Si+0.5\times\%\ Nb+2\times Ti \quad (1)$$

In order to successfully insert the rolling rods, the rod surface must have a specific minimum hardness prior to nitriding. Tests have shown that this limit is 200 HV 0.5 measured 0.5 mm below the surface of the non-nitrided rod. In this case, it is advantageous if this minimum hardness extends into the core of the rod, wherein at least 60% of the minimum hardness should still be present in 50% of the diameter of the rolling rod.

In accordance with an aspect of the invention, the application of the nitriding layer onto the rolling rod occurs at a temperature which is a maximum of 20% below the tempering temperature of the steel material of the rolling rod.

For nitriding process, the method, be it gas-based or plasma-based, is not significant. The only important factor is the formation of the nitriding layer with the required characteristics. In an advantageous manner, it should have a nitriding hardness depth of more than 0.15 mm. Furthermore, a near-surface hardness of more than 950 HV 0.5 is required, measured at cross-section polishes of reference samples also involved in the nitriding process. The following Table 1a shows the chemical composition of various tested rod materials.

| Material | | C | Si | Mn | Cr | Mo | V |
|---|---|---|---|---|---|---|---|
| A | min | 0.3 | 0.7 | 0.4 | 4.5 | 1 | 0.8 |
| | max | 0.4 | 1.2 | 0.6 | 5.5 | 1.2 | 1 |
| B | min | 0.33 | 0.8 | 0.25 | 4.8 | 1.1 | 0.3 |
| | max | 0.41 | 1.2 | 0.5 | 5.5 | 1.5 | 0.5 |
| C | min | 0.35 | 0.8 | 0.25 | 4.8 | 1.2 | 0.85 |
| | max | 0.42 | 1.2 | 0.5 | 5.5 | 1.5 | 1.15 |
| D | Ref. | 0.32 | 0.2 | 0.2 | 3 | 2.8 | 0.5 |
| E | Ref. | 0.55 | 0.3 | 0.8 | 1.1 | 0.45 | 0.1 |

The following Table 1 b shows the calculated values for the chromium equivalent $Cr_{eq}$-calculated according to equation (1) $Cr_{eq.}$ (wt. %)=% Cr+% Mo+1.5×% Si+0.5×% Nb+2×% Ti and whether a sufficient nitriding layer thickness, nitriding layer depth and basic hardness have been achieved.

| Material | | $Cr_{eq.}$ | Sufficient nitriding layer thickness, nitriding layer depth and basic hardness |
|---|---|---|---|
| A | min | 6.6 | Yes |
| | max | 8.5 | |
| B | min | 7.1 | Yes |
| | max | 8.8 | |
| C | min | 7.2 | Yes |
| | max | 8.8 | |
| D | Ref. | 6.1 | No |
| E | Ref. | 2.0 | No |

The materials A, B and C have a chromium equivalent which is above the required value of 6.5, whereas the reference materials D and E have lower values.

Figure 1:
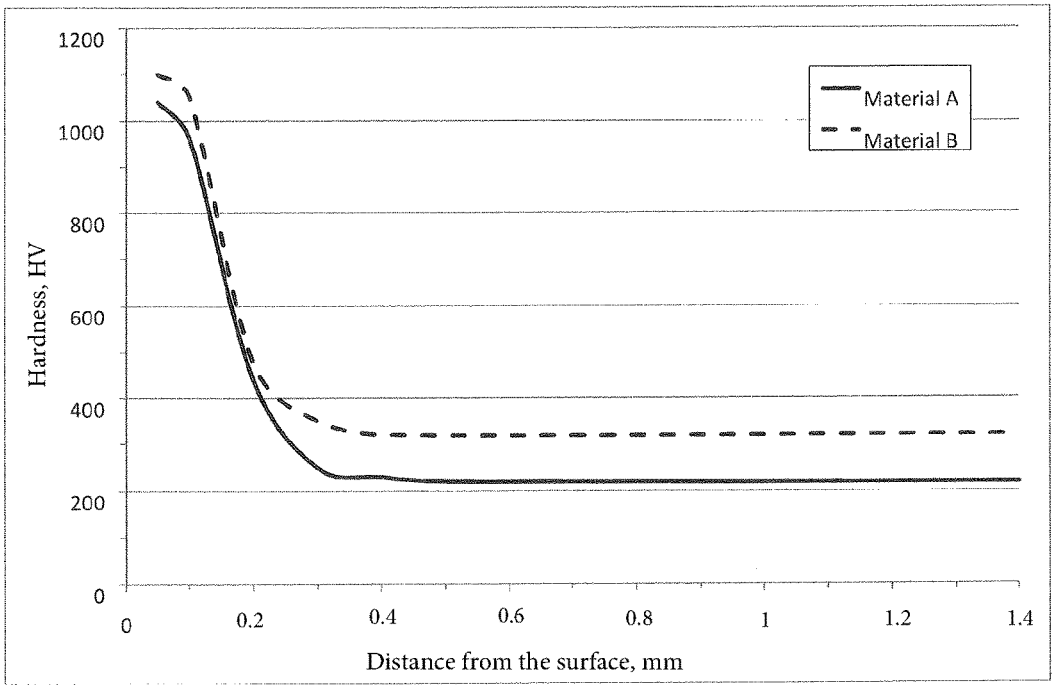
FIG. 1 shows the hardness and nitriding layer depths achieved for two materials.

For the first two rod materials A, B as shown in Tables 1a and 1b, FIG. 1 shows which hardness and which nitriding layer depths have been achieved during nitriding. It is apparent that the required minimum hardness of 200 HV 0.5 is safely achieved even at greater depths than 0.5 mm starting from the surface of the rolling rod.

Since during rolling the rolling rods heat up considerably, in general to above 500° C., on the surface and in order to ensure that this heating does not cause strength losses or damage, the hot working steel used must also have, in addition to the aforementioned chromium equivalent, a yield point of at least 450 MPa and a tensile strength of at least 600 MPa at 500° C.

The lubricant must also satisfy specific conditions. Lubricants, when being sprayed onto the rolling rod, still contain water which should be completely vaporised where possible prior to threading the rolling rod into the hollow block. In order to ensure complete vaporisation, the surface temperature of the rolling rod should advantageously be at least 70° C. prior to application of the lubricant.

Tests have also shown that a surface weight of at least 40 g/m$^2$ lubricant on the rolling rod is required as a remaining dry quantity, in order to ensure an adequate lubricating effect during rolling. When rolling steels having a chromium proportion of more than 5 wt. % it has been shown to be particularly advantageous if at least twice the dry quantity of lubricant, i.e. at least 80 g/m$^2$, is applied onto the rolling rod. In this case, the quantity of lubricant applied is based on the surface of the rolling rod.

Tests have also shown that a period of time after the end of the application of lubricant onto the rolling rod until the commencement of threading the rolling rod into the hollow block of at least 60 seconds is required to ensure that the lubricant can dry sufficiently.

It is also conducive to the service life of the rod if the load is distributed over the longest possible length. On the other hand, the working part of the rolling rod $L_{ST}$ must not be too long as otherwise the rod weights become excessive. It has been shown to be particularly advantageous if the rod length is limited to a maximum of 50% of the maximum possible rolling length in the rod rolling mill.

For this purpose, the following formula applies:

$$L_{STmax}=0.5\times\text{maximum pipe run-out length, last stand of a multiple-stand rolling mill} \quad (2).$$

In this case, the rolling rod consists of a working part and a blank part, wherein at least the working part is provided with the nitriding layer.

At the same time, the speed of the rod $V_{ST}$ must not exceed a maximum value for the ratio of rod length/rolling time because otherwise the working region of the rods is exceeded during rolling. In this case, the rolling time of the last stand of the rod rolling mill is defined as the rolling time.

However, for an assured process sequence it is recommended not to completely exploit the possible speed and not to exceed an upper limit of 90% of this value.

The following formula applies: $V_{STmax}$=0.9×rod length/rolling time of last stand.

Moreover, the rod speed $V_{ST}$ must never exceed the speed $V_M$ of the pipe material during rolling in the rod rolling mill, as otherwise the direction of the friction forces reverses. In this case, a limitation to 90% of the maximum permitted value of the minimum speed of the pipe material $V_{M\ min}$ is also expedient.

Therefore, the following formula applies: $V_{ST\ max}=0.9\times V_{M\ min}$

Two further variables which have a decisive influence on the successful use of nitrided rolling rods are the difference between the hollow block inner diameter and the rolling rod diameter, referred to as clearance, and the temperature of the hollow block at the moment when the rolling rod is threaded in.

In order to avoid possible stripping of the lubricant from the rolling rod as it is being threaded into the hollow block and yet still ensure reliable threading-in, this clearance should be at least 10 mm and the average temperature of the hollow block should be above 1000° C.

Even though impressive service lives of the rolling rods can be achieved by the inventive rolling rod and the inventive rolling method, without additional deoxidising of the inner surface of the hollow block being required, in the case of materials which are difficult to form it may be advantageous in certain cases to perform an additional deoxidation, wherein the surface weight of the deoxidant is then at least 100 g/m$^2$ and the time between the end of the application of deoxidant and the commencement of rolling on the rolling rod should be at least 30 s. The quantity of deoxidant applied is based on the inner surface of the hollow block.

Figure 2:
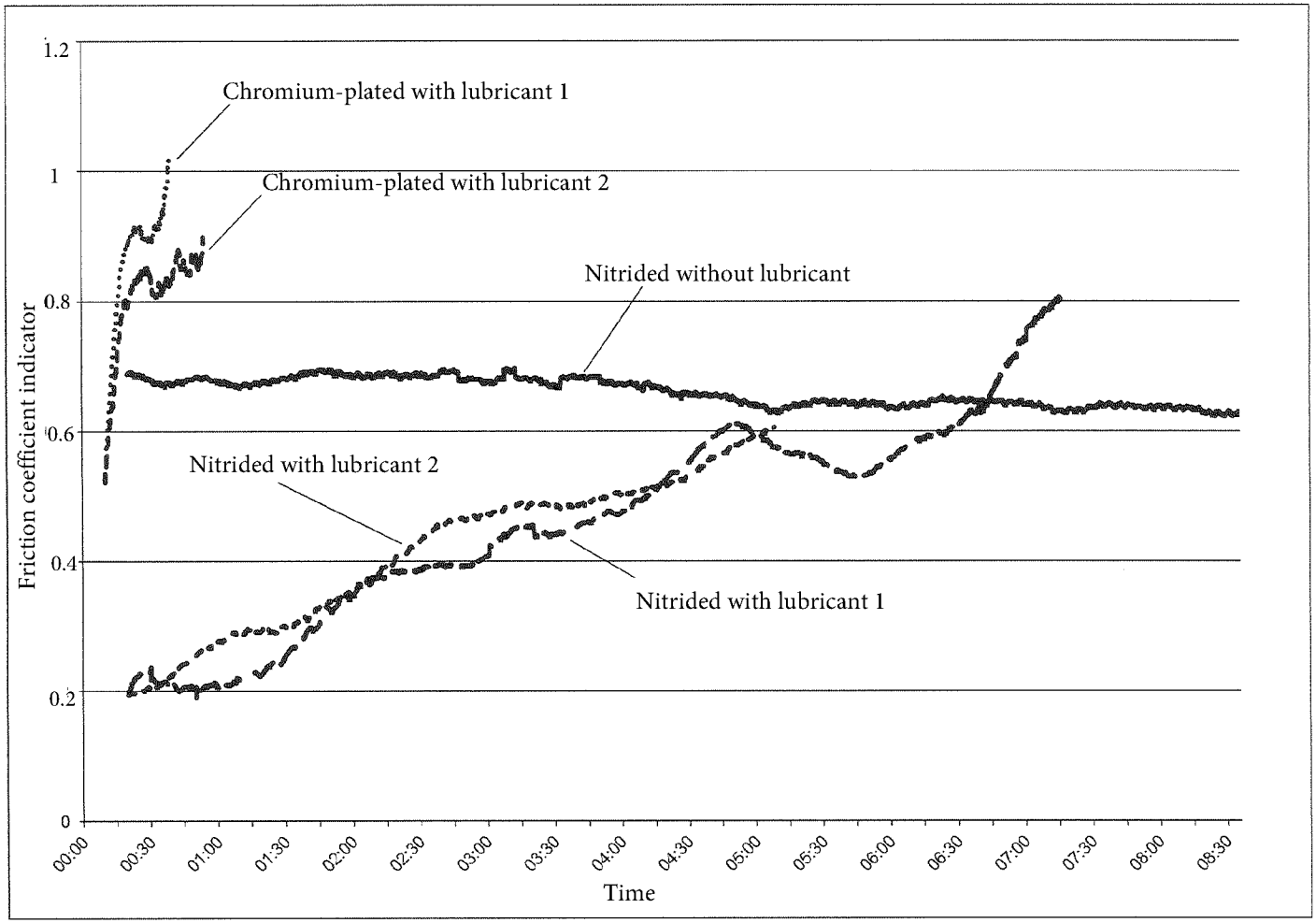
FIG. 2 illustrates test results relating to the friction behaviour of untreated, chromium-plated and nitrided rolling rods in conjunction with different lubricants.

Test results relating to the friction behaviour of untreated, chromium-plated and nitrided rolling rods in conjunction with different lubricants are illustrated in FIG. 2.

It is apparent that the chromium-plated and lubricated surface actually produces poorer values for the coefficient of friction indicator than the untreated, lubricated surface (not illustrated in FIG. 2). It can also be seen that the unlubricated, nitrided surface has very good emergency operating characteristics. Even after a short period of time, the associated coefficient of friction indicator is well below the values for the lubricated, chromium-plated surfaces. These dependencies are substantially independent of the different lubricants 1 or 2.

This behaviour is also known from practical experience. The lubricant does not adhere very well to newly chromium-plated rods, so that in this case the deoxidation of the hollow block, which produces an additional lubricating film, must assist the lubrication. Moreover, further measures, such as double lubrication or special lubricants, are frequently used for inserting the rolling rod, which is very complex and causes additional cost.

In a further advantageous embodiment of the invention, the nitriding of the surface of the inventive rolling rod is performed in such a manner as to promote the formation of pores which are open towards the surface and which act as lubricant pockets or reservoirs and thus increase the service life of the rolling rod by improved lubrication.

The invention claimed is:

1. A rolling rod as an inner tool in a production of seamless metallic hollow bodies, said rolling rod having a surface comprising a nitriding layer, wherein the rolling rod comprises a heat-resistant steel material having a chromium equivalent $Cr_{eq.}$ of more than 6.5, calculated according to $Cr_{eq.}$=% Cr+% Mo+1.5×% Si+0.5×% Nb+2×% Ti, having a minimum hardness of 200 HV 0.5, measured 0.5 mm below the surface of the rolling rod, having a yield point of at least 450 MPa at 500° C. and having a tensile strength of at least 600 MPa at 500° C., and that starting from the surface, the nitriding layer has a depth of more than 0.15 mm and a nitriding hardness of more than 950 HV 0.5.

2. The rolling rod as claimed in claim 1, wherein at least 60% of the minimum hardness remains in 50% of the diameter of the rolling rod.

3. The rolling rod as claimed in claim 2, wherein the rolling rod includes said nitriding layer applied at a maximum of 20% below the tempering temperature of the steel material of the rolling rod.

4. The rolling rod as claimed in claim 3, wherein the rolling rod includes a lubricant applied onto the surface of the rolling rod and dried prior to commencement of rolling, wherein the lubricant has a surface weight of at least 40 $g/m^2$.

5. The rolling rod as claimed in claim 4, wherein the surface weight of the lubricant applied onto the rolling rod comprising of steel material having chromium content of more than 5 wt. % is at least 80 $g/m^2$.

6. The rolling rod as claimed in claim 2, wherein the rolling rod includes a lubricant applied onto the surface of the rolling rod and dried prior to commencement of rolling, wherein the lubricant has a surface weight of at least 40 $g/m^2$.

7. The rolling rod as claimed in claim 6, wherein the surface weight of the lubricant applied onto the rolling rod comprising of steel material having chromium content of more than 5 wt. % is at least 80 $g/m^2$.

8. The rolling rod as claimed in claim 1, wherein the rolling rod includes said nitriding layer applied at a maximum of 20% below the tempering temperature of the steel material of the rolling rod.

9. The rolling rod as claimed in claim 1, wherein the rolling rod includes a lubricant applied onto the surface of the rolling rod and dried prior to commencement of rolling, wherein the lubricant has a surface weight of at least 40 $g/m^2$.

10. The rolling rod as claimed in claim 9, wherein the surface weight of the lubricant applied onto the rolling rod comprising of steel material having chromium content of more than 5 wt. % is at least 80 $g/m^2$.

11. The rolling rod as claimed in claim 1, wherein the rolling rod consists of a working part and a blank part and the working part of the rolling rod $L_{ST}$ has a maximum length, calculated according to $L_{ST\ max}$=0.5×maximum pipe run-out length based on a last stand of a multiple-stand rolling mill.

12. The rolling rod as claimed in claim 1, wherein the rolling rod is used as inner tool for stretch-forming of metal hollow blocks to form seamless pipes.

13. A method for producing a seamless, hot-rolled, metallic hollow steel pipe comprising:

producing a hollow block that is subject to a stretch-forming procedure in a multiple-stand rolling mill;

applying a liquid lubricant to a rolling rod for the multiple-stand rolling mill, with the rolling rod having a surface comprising a nitriding layer, wherein the rolling rod comprises a heat-resistant steel material having a chromium equivalent $Cr_{eq.}$ of more than 6.5, calculated according to $Cr_{eq.}$=% Cr+% Mo+1.5×% Si+0.5×% Nb+2×% Ti, having a minimum hardness of 200 HV 0.5, measured 0.5 mm below the surface of the rolling rod, having a yield point of at least 450 MPa at 500° C. and having a tensile strength of at least 600 MPa at 500° C., and that starting from the surface, the nitriding layer has a depth of more than 0.15 mm and a nitriding hardness of more than 950 HV 0.5;

drying the rolling rod after said applying said liquid lubricant to the rolling rod;

performing said stretch-forming procedure on the hollow block in the multiple-stand rolling mill using the rolling rod after said drying the rolling rod, wherein said stretch-forming comprises threading the rolling rod into the hollow block with a clearance with respect to an inner diameter of the hollow block of at least 10 mm, and immediately prior to commencement of threading-in of the rod, the hollow block has an average temperature of at least 1000° C. and a speed of the rod $V_{ST}$ during rolling in the rolling mill satisfies at least a plurality of conditions such that: $V_{STmax}$=0.9×rod length/rolling time of last stand and $V_{STmax}$=0.9×$V_{Mmin}$, wherein $V_{Mmin}$ is a minimum speed of the hollow block during rolling in the rolling mill; and forming the pipe.

14. The method as claimed in claim 13, wherein a drying time after said applying said liquid lubricant to the rolling rod and prior to the commencement of threading-in of the rod is at least 60 seconds.

15. The method as claimed in claim 14, wherein said liquid lubricant is applied onto the rolling rod at a surface temperature of the rolling rod of at least 70° C.

16. The method as claimed in claim 15, wherein a quantity of said liquid lubricant applied is metered in such a way that after said drying a surface weight of at least 40 $g/m^2$ is achieved.

17. The method as claimed in claim 16, wherein the quantity of said liquid lubricant applied onto the rolling rod comprising of steel material having chromium content of more than 5% is metered in such a way that after said drying a surface weight of at least 80 $g/m^2$ is achieved.

18. The method as claimed in claim 17, further comprising applying a deoxidant to an interior of the hollow block prior to said threading-in of the rolling rod, wherein a quantity of said deoxidant is at least 100 $g/m^2$, and a time period after said applying of said deoxidant and prior to the commencement of threading-in of the rod is at least 30 seconds.

19. The method as claimed in claim 13, wherein said liquid lubricant is applied onto the rolling rod at a surface temperature of the rolling rod of at least 70° C.

20. The method as claimed in claim 13, wherein a quantity of said liquid lubricant applied is metered in such a way that after said drying a surface weight of at least 40 $g/m^2$ is achieved.

21. The method as claimed in claim 20, wherein the quantity of said liquid lubricant applied onto the rolling rod comprising of steel material having chromium content of more than 5% is metered in such a way that after said drying a surface weight of at least 80 $g/m^2$ is achieved.

22. The method as claimed in claim 13, further comprising applying a deoxidant to an interior of the hollow block prior to said threading-in of the rolling rod, wherein a quantity of said deoxidant is at least 100 $g/m^2$, and a time period after said applying of said deoxidant and prior to the commencement of threading-in of the rod is at least 30 seconds.

* * * * *